US007455298B1

(12) United States Patent
Nettle

(10) Patent No.: US 7,455,298 B1
(45) Date of Patent: Nov. 25, 2008

(54) ARCHERY TARGET METHOD AND APPARATUS

(76) Inventor: Robert Nettle, 29076 Highway 190 West, Lacombe, LA (US) 70445

( * ) Notice: Subject to any disclaimer, the term of this patent is extended or adjusted under 35 U.S.C. 154(b) by 0 days.

(21) Appl. No.: 11/890,237

(22) Filed: Aug. 4, 2007

Related U.S. Application Data

(63) Continuation-in-part of application No. 10/935,787, filed on Sep. 7, 2004, now abandoned.

(51) Int. Cl.
*F41J 3/00* (2006.01)

(52) U.S. Cl. ..... 273/403

(58) Field of Classification Search ..... 273/403, 273/404, 407, 408
See application file for complete search history.

(56) References Cited

U.S. PATENT DOCUMENTS

| | | | | |
|---|---|---|---|---|
| 4,203,600 | A * | 5/1980 | Brown | 273/407 |
| 4,657,261 | A * | 4/1987 | Saunders | 273/392 |
| 5,503,403 | A * | 4/1996 | Morrell | 273/403 |
| 6,068,261 | A * | 5/2000 | Nettle | 273/408 |
| 6,254,100 | B1 * | 7/2001 | Rinehart | 273/403 |
| 6,575,469 | B2 * | 6/2003 | Love | 273/403 |
| 6,926,281 | B1 * | 8/2005 | Woock | 273/403 |
| 7,258,345 | B2 * | 8/2007 | Anderson, Jr. | 273/408 |
| 2002/0113372 | A1 * | 8/2002 | Love | 273/408 |
| 2004/0140623 | A1 * | 7/2004 | Pulkrabek | 273/408 |

* cited by examiner

*Primary Examiner*—Mark S Graham
(74) *Attorney, Agent, or Firm*—Robert N. Montgomery

(57) ABSTRACT

A three dimensional, animal-shaped archery target molded of polyurethane foam in two members consisting of a body member and a head member. The body member having a cavity therein for containing a replaceable target insert retained in place by a replaceable, sliding foam panel conforming externally to the shape of the animal located on one or both sides of the target insert thereby fully concealing the insert. A repairable clay core insert or various replaceable target inserts may be used including foam or packed cotton.

9 Claims, 4 Drawing Sheets

ARCHERY TARGET METHOD AND APPARATUS

This is a Continuation-In-Part application relying on applicant's previously filed non-Provisional application Ser. No. 10/935,787 filed Sep. 7, 2004 now abandoned under 35 USC 120.

FIELD OF THE INVENTION

This invention relates generally to archery targets and more particularly to free standing 3-D foam animal targets with replaceable target inserts with indestructible cores.

GENERAL BACKGROUND

Three dimensional animal archery targets have been in use nearly since the advent of urethane foam compositions. As foam mixtures improved so have archery targets. Currently such targets utilize high-density cellular foam molded into a variety of animal shapes. Such targets are relatively lightweight and fabricated in one piece or in several replaceable sections. The foam targets are generally sufficient to allow several hundred shots using target point, field point or broadhead tipped arrows. However, due to damage to the cellular structure from numerous arrow shots, the target or at least some portion of the target must be replaced usually each year at considerable expense. The degree of damage and the area affected depends on the hunter's choice of arrow types and ability to concentrate shots in the kill zone. Therefore, it becomes obvious that the area of the target with the most concentrated damage should be replaceable and kept to a minimum size to reduce cost.

Three-dimensional animal archery, targets are widely used by bow hunters to perfect their hunting skills beyond simply hitting the target. Such realistic targets are used to inspire the archer and hone his skills in striking the animal in its vital organs. In many cases, compromises are made in the pursuit of realism, particularly in the context of target choices. The archer's preference of form over function can make an object intended to improve archery skills impractical. Practice with highly destructive broadhead-tipped arrows, in preparation for hunting, requires that archers, desiring to use 3-D targets, must choose between expensive targets that are unable to sustain the damage inflicted by broadheads or the even more expensive sectional targets requiring frequent replacement of the vital organ section.

Even 3-D animal targets with replaceable inserts, when used with Broadhead-tipped arrows, require frequent replacement inserts and eventual mid section replacement as well. Such inserts cause as many problems as they solve due their inability to provide sufficient stopping power for the arrow. In some cases mid barriers made of wood are used to prevent the arrow from going completely through the target. As the inserts become damaged due to multiple shots, they allow more penetration of the arrow thereby leading to target depletion, arrow pass-throughs, arrow damage, and dislodged and embedded broadheads (rendering the adjacent target area unusable due to the high potential for damage to subsequently shot arrows.

The above disadvantages and other drawbacks to using single piece or sectional 3-D animal targets with or without replaceable inserts emphasize the need for an indestructible or less expensive target assembly.

The prior art teaches the use of placing removable inserts within a body cavity. However, such teachings rely on wedged shaped cavities alignment grooves and support rods passing through the body members and through the replaceable insert to secure the insert in place.

Other means for securing a replaceable insert in place have been suggested such as the use of straps or wire or perhaps a cloth or molded foam covers such as is taught by Morrell in U.S. Pat. No. 5,503,403.

An easily removable relatively inexpensive long lasting insert is therefore still needed for such three-dimensional animal targets. The following specification discloses a more functional long lasting insert that is virtually indestructible and a method for securing the insert in place within a natural looking three dimensional animal form.

Inserts for animal targets are well known within the art. However, such inserts are becoming more complex and thus must be carefully compared with regard to their longevity, stopping power and cost of replacement. Due to the advent of new more user friendly open face targets such as foam targets having clay cores, as is taught by Robert Nettle in U.S. Pat. No. 6,068,261, can now be used as inserts in three-dimensional animal target described herein. An insert having a core would both optimize and enhance the unique properties of clay as implemented in an archery target. When used in an open-face core configuration, those properties, namely clay's malleability and susceptibility to variation in ambient temperature and the heat generated during arrow impact, cause it to expand both outward and concentrically from the core's boundary during use; in effect, mushrooming forward and outward from its original borders. This occurs as a result of the kinetic energy absorbed during arrow impact and, also during arrow removal, due to the force necessary to break the vacuum seal forming around the arrow, as well as the act of pulling the arrow's broadhead-tipped blades backwards through the clay. Left uncorrected during use, by failing to periodically repack the core with a maul or even mash the clay back into the central core barehanded, expansion of the clay continues until enough extends beyond the core's boundaries to degrade its integrity in adequately stopping arrows to the point that the target backstop and rear foam wall eventually become subject to the penetration of arrows and, consequently, ultimate depletion. Based on the correlation between the ambient temperature and malleability of the clay, when used in non-temperate conditions, after several hours the clay core has the potential to become degraded. Depending on the kinetic energy delivered by the bow, arrow and tip combination used, in extremes of heat, the core's ability to stop arrow penetration can be reduced to the extent that the backstop and rear foam layer are compromised; and in extremes of cold the clay's resistance to arrow penetration increases to the point of damaging arrow tips and shafts. Lastly, when broadhead-tipped arrows are withdrawn from an open-faced clay core, trace amounts of clay are often found on the arrow shaft and along the back edges of the broadhead. This is generally consistent with the amounts of residue associated with removing broadhead-tipped arrows from polyurethane foam targets, however due to the adhesive properties of the clay and relative to the ambient temperature, may sometimes be more difficult to remove.

SUMMARY OF THE INVENTION

A three dimensional, animal-shaped archery target molded of polyurethane foam in one or more members, the body having a cavity or orifice therein for containing a replaceable target insert having a central core. The insert retained within the cavity or orifice by replaceable, sliding foam panel conforming to the exterior contours of the animal located on one or both sides of the target insert thereby fully concealing the insert. A repairable clay core insert or various replaceable target inserts may be used including foam, compacted cotton, straw, other suitable materials or a combination thereof.

Unlike other three dimensional foam animal targets utilizing inserts and/or replaceable core members and coverings, the instant invention utilizes a concealed insert having a compacted repairable core thereby making the vital organ kill zone of the target indestructible except for the inexpensive replaceable removable slide-in contoured external panels. The replaceable external panels also provide a way to help clean Broadhead-tipped arrows when being withdrawn from the compacted insert core material and further serve as way to hold the insert in position. The panels are also provided with engraved indicia defining the kill zone and vital organ areas.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

5. DETAILED DESCRIPTION OF THE PREFERRED EMBODIMENT

Figure 1:
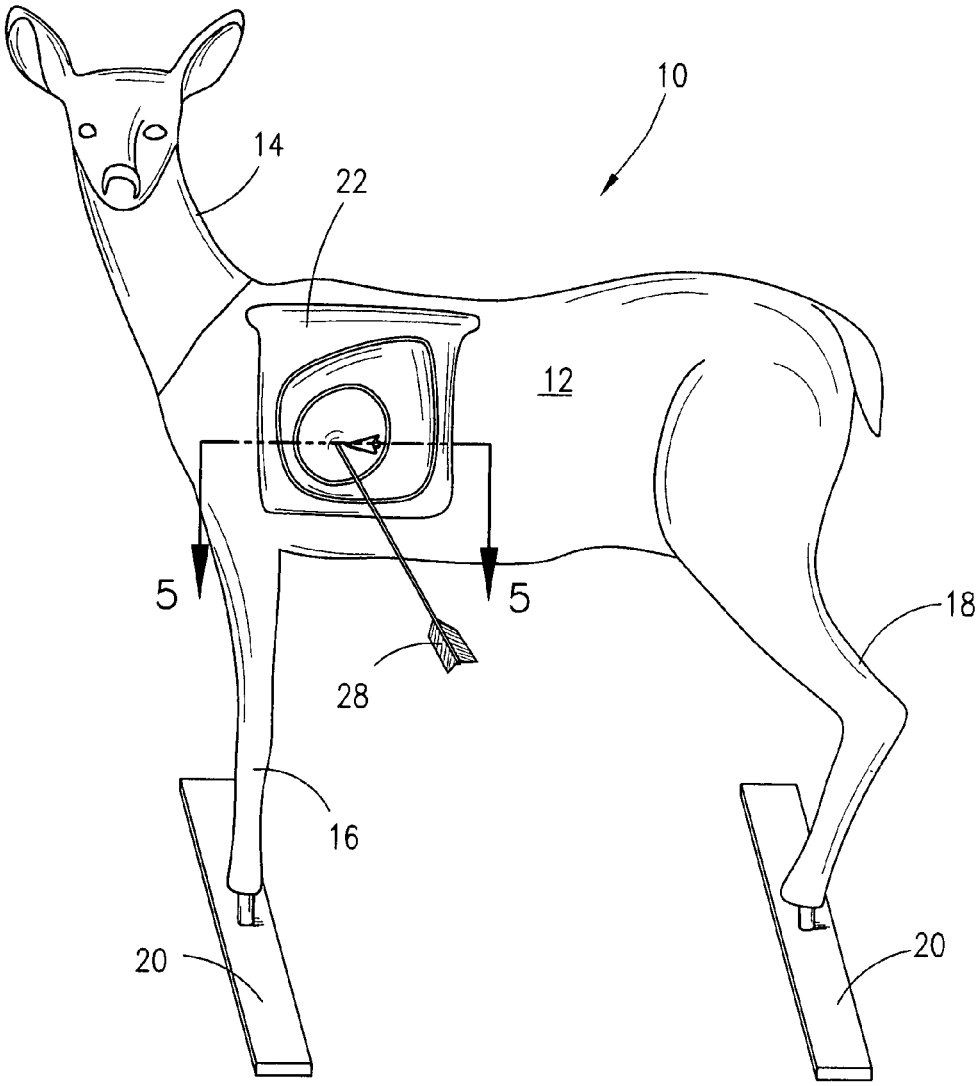
FIG. 1 is a front isometric view of the preferred embodiment.

Three-dimensional animal targets may take any animal shape. However, for discussion purposes the improved strike zone insert is described herein as related to a deer shaped target as sown in FIG. 1. In this case the three dimensional target 10 takes the form of a foamed-in-place deer shape composed of two basic elements, a body portion 12 and a removable head portion 14. The body portion 12 is vertically supported upon two front and two rear legs 16,18 combined into a column connected to horizontal boards 20. The front and rear legs may be a single column as shown in FIG. 1 or have all four legs separated and supported on the front and rear boards 20.

Figure 2:
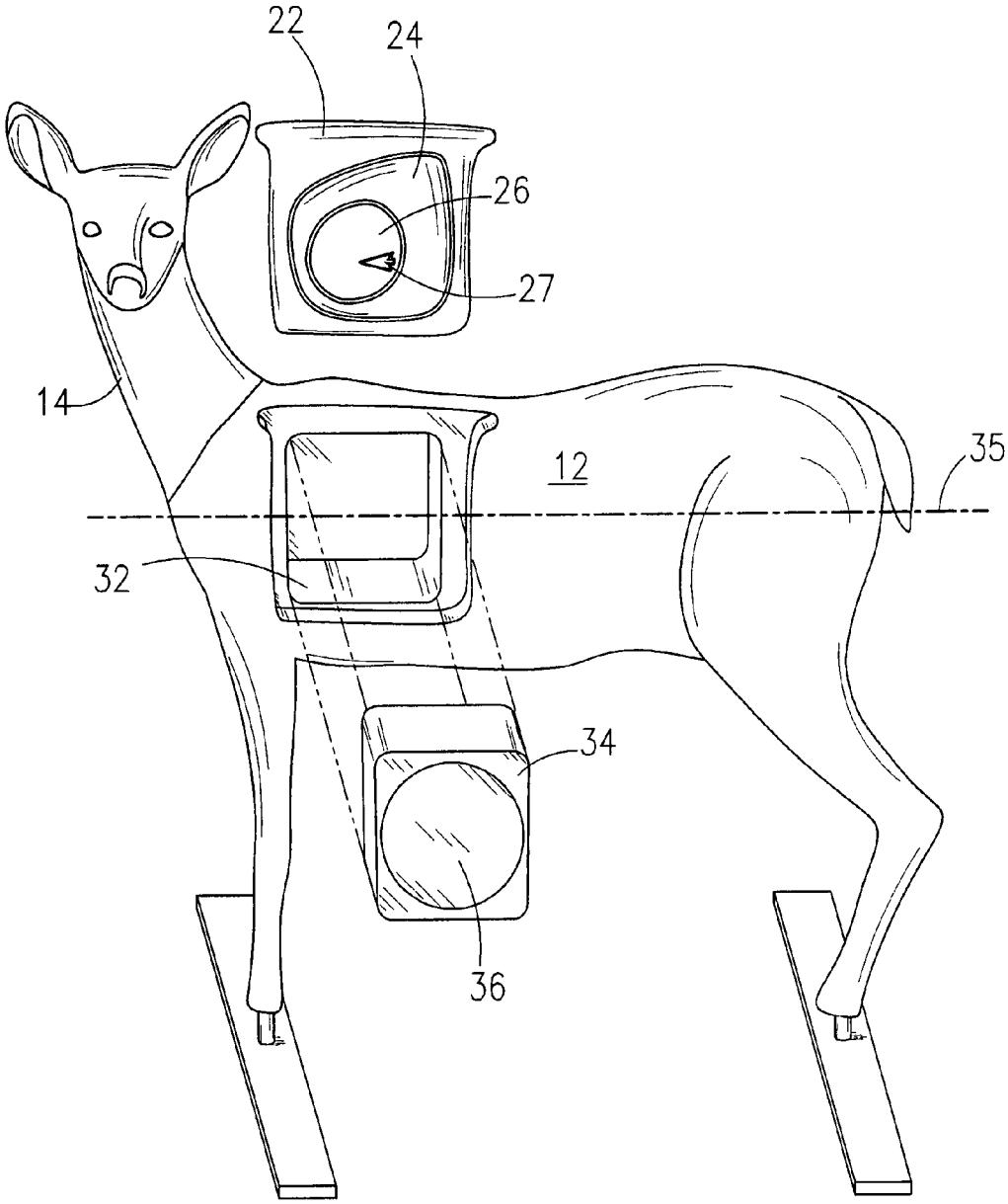
FIG. 2 is an expanded view of the insert and front retaining panel relative to the 3-D foam animal target.

A removable foam kill zone cover panel 22 having an exterior shape conforming to the external form of the deer body portion 12 is provided in the area of the kill zone located just behind the animal's front leg shoulder area, as seen in FIG. 2. The inexpensive replaceable panel 22 may also include indicia engraved therein 24,26 further defining the kill zone and location of vital organs, i.e. heart and lungs. An arrow 28 striking the indicia identified zone area 26 for example, as seen in FIG. 1, is considered a kill shot. Additional indicia may include an arrowhead symbol 27 or a scoring target/system officially sanctioned by one or more recognized archery organization.

Figure 3:
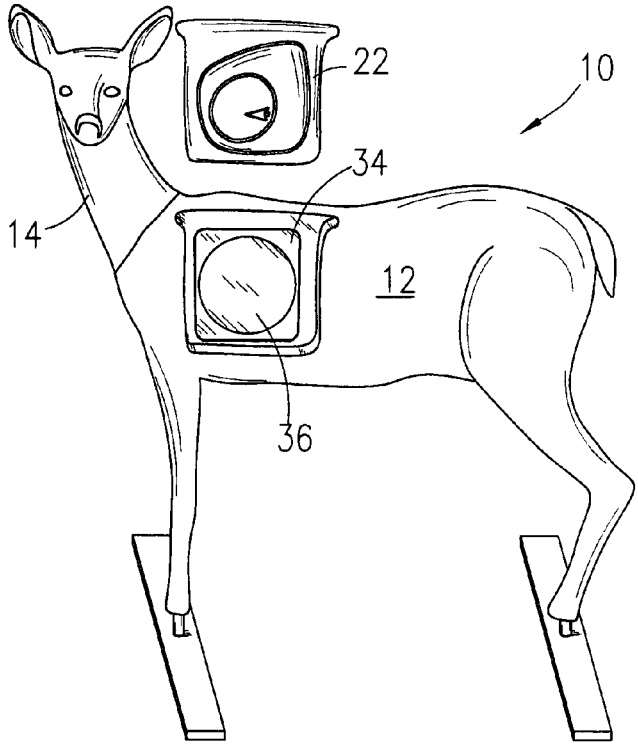
FIG. 3 is a front isometric view of the preferred embodiment with front insert retaining panel removed.
Figure 4:
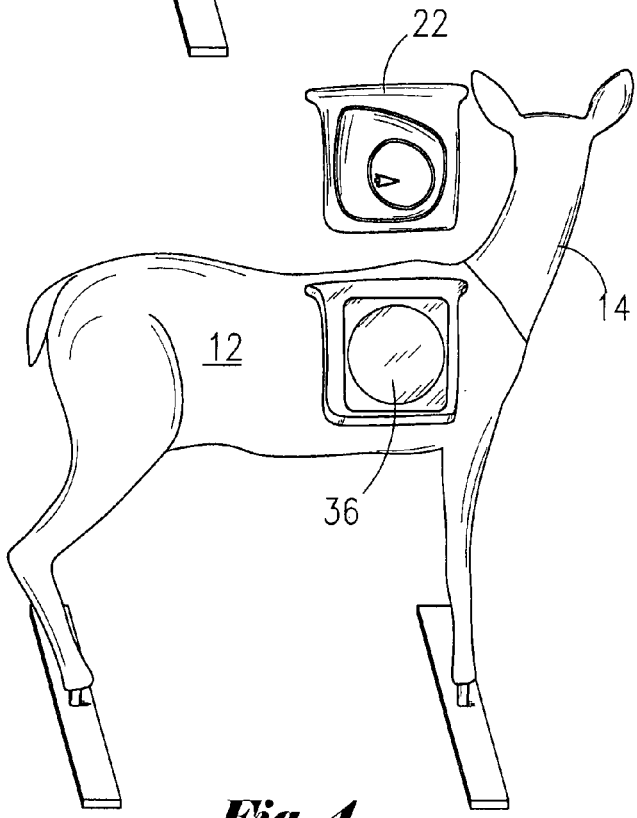
FIG. 4 is a rear isometric view of the preferred embodiment with rear insert retaining panel removed.
Figure 5:
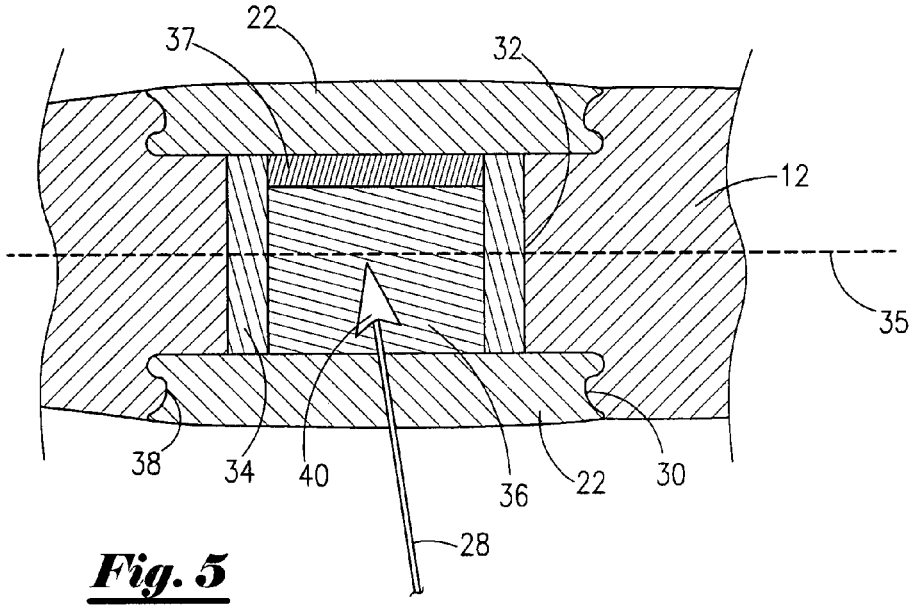
FIG. 5 is a cross-section view taken along the sight lines 5-5 shown in FIG. 1.

The panel 22 is provided with grooves 30, as seen in FIG. 5, located along each of its vertical sides conforming to cooperative ridges 38 formed within the body portion 12 to allow the panel 22 to be slidably removed vertically as shown in FIG. 3. The removable panels 22 form an integral part of the body portion 12. However, other methods may be employed for removal of such panels as well. A reverse image panel 22 may be provided on the reverse side of the target as seen in FIG. 4 to allow the target to be shot from either side. As seen in cross-section in FIG. 5, a panel 22 that forms an integral part of the body 12 represents the kill zone. These slide out panels 22 cover the mouth of a passage or tunnel shown in FIG. 5 herein as a extending clear through the body 12. Therefore, a panel 22 may be located at the mouth of each end of the tunnel or hole 32. Thereby, differing from other 3-D foam targets having channels cut into the body for receiving a plurality of foam panels. It should also be understood that a cavity as defined herein is an opening to a blind hole surrounded on all sides extending only partially through the body 12 and not simply a hollowed out portion of the target body. Describing a cavity is very difficult. However, the cavity or orifice herein is defined as an opening to a blind hole surrounded on all sides and extending inwardly perpendicular to the central vertical longitudinal plane 35 seen in FIG. 5. Most cavities located in foam animal targets are not surrounded on all sides and/or do not extend clear through the target perpendicularly to the central vertical longitudinal plane. Therefore, a single cavity may be employed for targets to be shot from only one side. However, the preferred embodiment has an orifice or cavity leading to a hole or tunnel 32 surrounded by the body 12, extending completely through the body 12 as seen in FIG. 2. The cavity, or orifice leading to the hole or tunnel 32 seen in FIG. 2 is located perpendicular to the longitudinal centerline 35 seen in FIG. 5.

A replaceable foam insert 34 conforming to the inside dimensions of the hole, tunnel 32, extending through and surrounded by the body 12 seen in FIG. 2, is provided for insertion within the hole, or tunnel 32. Foam insert 34 also includes a pliable reconfigurable central core material 36 having a higher density than the foam insert 34 and body portion 12. This central core material 36 is important in that it must have sufficient density to stop the arrow from penetrating the entire target yet soft enough to prevent damage to the arrow itself. Various types of core materials 36 may be used for this purpose, including highly compacted clay, cotton, straw, or any suitable material or preferably a combination thereof.

Arrow penetration of the foam panel 22 is insufficient in and of itself to stop an average arrow shot. Therefore, the core material 36 located within the insert 34 must absorb the arrow's velocity without damage to the arrow 28 thus, a compacted core material is necessary.

The compacted core material 36 located within the foam insert 34 in this case absorbs the velocity of the arrow and is retained within the hole or tunnel 32 by at least one of the removable cover panels 22. Where the animal target 10 is fitted with removable panels 22 on both sides of the insert, the removable panels 22, as shown in FIG. 5, retain the insert 34 and its core material 36.

Use of broad-head tipped hunting arrows tends to make arrow 28 recoveries very difficult. In many cases broadheads become entangled in the fibrous fill used in most target core material. In some cases heat generated during penetration of the target core by high-speed carbon arrows, actually become fused in such core material, thus leaving large holes in the target when removed or leaving an unusable portion of the target core when dislodged from the shaft of the arrow. Such embedded broad-heads pose a safety hazard and potential damage to subsequent arrow shots. By using a compacted clay core 36, or cotton, straw etc. combination as the central core material 36, removal of the arrow's broadhead from the core 36 through the panel 22 tends to insure that the core's material remains within the foam insert 34. The external panel 22 further tends to remove any core material 36 residue from the arrow shaft and tip as shown in FIG. 5, upon withdrawal thereby retaining the core material 36 within the insert 34. The fact that a clay core material or combinations thereof is reparable makes the insert 34 containing such core material easily repairable and thus virtually indestructible. Other repairable highly compacted compositions may be used as the core material 36 if desired and is thus fully anticipated by the invention.

Figure 6:
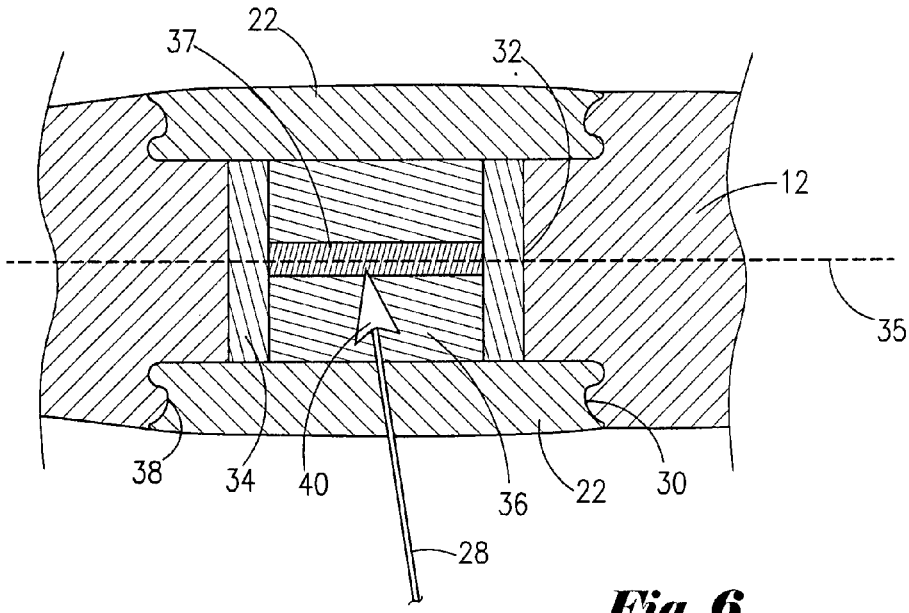
FIG. 6 is a horizontal plane cross-section view of the target taken along center line 35 seen in FIG. 2.

The replaceable foam panels 22, covering the insert 34 seen in FIG. 6 serves several functions. Encasing the clay core material 36 with the foam insert 34, overcomes its natural tendency of the core material 36 to expand both during the impact of penetrating arrows and during their extraction. These effects are redirected into a regenerative self-repairing wound healing action. Associated energies otherwise dissipated through the expansion of the clay based core material 36 beyond its borders have no path for release other than generating additional heat and internally compressing holes in the clay based material made by previous arrows having penetrated the core material, thereby enhancing the reparative properties of the clay.

With the insert 34 having a clay based core material 36 completely encased in a foam body the insulating properties greatly enhance the consistency of the clay during extremes of both heat and cold. This ensures a full day of usability and as an arrow is withdrawn from the target zone, upon exiting the boundary of the clay core material 36 the arrow must pass through the outer foam cover panel 22; the squeegee-like effect of being drawn through the foam removes most of the residual traces of the clay based material 36 clinging to the arrow shaft and tip 28.

In cases where it is impossible to provide a sufficient depth of the central clay based material core 36 to adequately stop an arrow, a high-density barrier 37 such as rubber may be used as a backup between the insert 34 and the removable panel 22 on the opposite side of the target being shot, as seen in FIG. 5. However, in some cases it may be beneficial to provide two inserts 34 laid end to end with a high-density barrier 37 located there between retained by an external panel 22 on each side to serve as a backstop if when shooting the target form either side.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A three-dimensional animal shaped archery target comprising:

a) a freestanding foam animal target having at least a body portion, said body portion having a defined kill zone;

b) a tunnel within said kill zone located horizontally and perpendicular to the vertical central longitudinal plane of said body portion extending though said body portion;

c) a foam insert member slidable within said tunnel;

d) a malleable clay based material forming a central longitudinal core located within said insert;

e) a removable barrier member located at one end of said tunnel; and f. a slide-in foam panel defining said kill zone independently covering an opening to said tunnel forming an integral part of said foam body said panel having exterior three-dimensional contours conforming to contours of said foam body portion surrounding said panel and said slide-in foam panel further comprising grooves cooperative with ridges located within said body portion adjacent openings to said tunnel.

2. The three-dimensional animal shaped archery target according to claim 1 wherein said barrier has a higher density than said clay based material.

3. The three-dimensional animal shaped archery target according to claim 2 wherein said barrier is located between one said slide-in panel and said insert member.

4. The three-dimensional animal shaped archery target according to claim 1 wherein said central longitudinal core is all clay.

5. The three-dimensional animal shaped archery target according to claim 4 wherein said insert is retained within said tunnel by said slide-in panel upon withdrawal of broad head arrows.

6. The three-dimensional animal shaped archery target according to claim 1 wherein said malleable clay based material is self-healing resulting from confinement within said insert and said tunnel.

7. The three-dimensional animal shaped archery target according to claim 6 wherein said slide-in foam panel is a cleaning element for arrow heads retracted from said clay based material upon withdrawal.

8. The three-dimensional animal shaped archery target according to claim 1 wherein said body portion comprises two inserts located within said tunnel and a said barrier member located there between.

9. The three-dimensional animal shaped archery target according to claim 1 wherein said insert is an insulating means for reducing ambient heat within said clay based central core.

* * * * *